United States Patent [19]

Tatum et al.

[11] 4,281,211

[45] Jul. 28, 1981

[54] WOVEN COVER FOR ELECTRICAL TRANSMISSION CABLE

[75] Inventors: Odes D. Tatum; Edgar A. Ross, both of Greenville, S.C.

[73] Assignee: Southern Weaving Company, Greenville, S.C.

[21] Appl. No.: 29,887

[22] Filed: Apr. 13, 1979

[51] Int. Cl.[3] ..... H01B 11/06

[52] U.S. Cl. ..... 174/36; 174/117 F

[58] Field of Search ..... 174/136, DIG. 11, 117 M, 174/117 F, 117 FF, 35 MS, 36, 124 R

[56] References Cited

U.S. PATENT DOCUMENTS

| | | | |
|---|---|---|---|
| 2,062,832 | 12/1936 | Saylor | 174/124 R |
| 2,585,054 | 2/1952 | Stachura | 174/36 |
| 3,254,678 | 6/1966 | Plummer | 174/36 X |
| 3,582,532 | 6/1971 | Plummer | 174/102 R X |
| 3,941,159 | 3/1976 | Toll | 150/52 R X |

*Primary Examiner*—Gene Z. Rubinson
*Assistant Examiner*—D. A. Tone
*Attorney, Agent, or Firm*—Bailey, Dority & Flint

[57] ABSTRACT

A flexible woven jacket assembly is disclosed for encasing woven electrical transmission cables providing a flexible package while maintaining the conductors of stacked cables generally fixed in their relative positions and providing protection against abrasion and unwanted electromagnetic noises. The woven jacket assembly includes a woven cover fabric formed from aromatic polyamide fibers woven together to form a solid outer cover fabric and various shielding is disclosed for reducing unwanted electromagnetic noises.

9 Claims, 4 Drawing Figures

WOVEN COVER FOR ELECTRICAL TRANSMISSION CABLE

BACKGROUND OF THE INVENTION

Heretofore, covers have been provided for protecting transmission cables from abrasion and shielding them against unwanted electrical noises. Typically, these covers have included heavy material having a zipper or other mechanical closures making them relatively rigid and cumbersome in jacketing transmission cables and routing them in use.

With the advent of more sophisticated electronics such as in computer, tele-communications, and missile systems, sensitive transmission cables having multiple conductors transmitting high frequency signals with rapid rise times have been required in which slight electrical and electromagnetic noises can be harmful. A small electrical noise such as a static charge of electricity produced by walking across a rug and touching a computer keyboard has been found to produce a signal in the transmission cable which falsely triggers a disk memory.

One attempt to provide a shielded jacket for a high frequency transmission cable is disclosed in U.S. Pat. No. 3,582,532 which discloses a flattened tubular jacket made from a plastic material having an open and closable seam. While providing some flexibility, the jacket assembly tends to be relatively rigid and return to its original shape when flexed.

Another problem with previous cable covers made from polyvinylchloride and other plastics are that they give off harmful gases such as chlorine if consumed by fire. Due to the increasing use of electronic installations, such as in office spaces, it is desirable to provide covers with improved flamability characteristics.

Accordingly, an important object of the present invention is to provide a woven jacket assembly which is lightweight and flexible which meets stringent flamability requirements.

Yet another important object of the present invention is to provide a woven jacket assembly for encasing flat type electrical transmission cables which provides a flexible package while still maintaining adjacent conductors of stacked cables in a generally fixed position relative to one another when flexed during routing.

Yet another important object of the present invention is to provide a woven jacket assembly for encasing electrical cable which is lightweight and flexible yet affords protection against abrasion.

Yet another important object of the present invention is the provision of a woven jacket assembly for enclosing electrical transmission cables which shields against unwanted electromagnetic noises.

SUMMARY OF THE INVENTION

It has been found that a highly flexible jacket assembly for enclosing woven electrical transmission cables and protecting same against abrasion and unwanted electromagnetic noises can be had by providing an elongated cover strip woven from aromatic polyamide fibers highly flame resistant and coated with a stabilizing coating to provide a better hand and more abrasion resistance to the cover fabric.

In one embodiment, the woven cover strip is woven to define marginal edges which are provided with Velcro fastener tape whereby the cover strip and fastener tape may be had to have a sufficient width to afford adjustability in the joining of the marginal edges to accommodate a variety of sizes and number of transmission cables. Electromagnetic shielding may be provided by a metal foil wrapped inside the cover strip and in an alternate embodiment, the shielding is provided by conductive fastener tapes.

BRIEF DESCRIPTION OF THE DRAWING

The construction designed to carry out the invention will be hereinafter described, together with other features thereof.

The invention will be more readily understood from a reading of the following specification and by reference to the accompanying drawing, wherein an example of the invention is shown and wherein.

DESCRIPTION OF A PREFERRED EMBODIMENT

Figure 1:
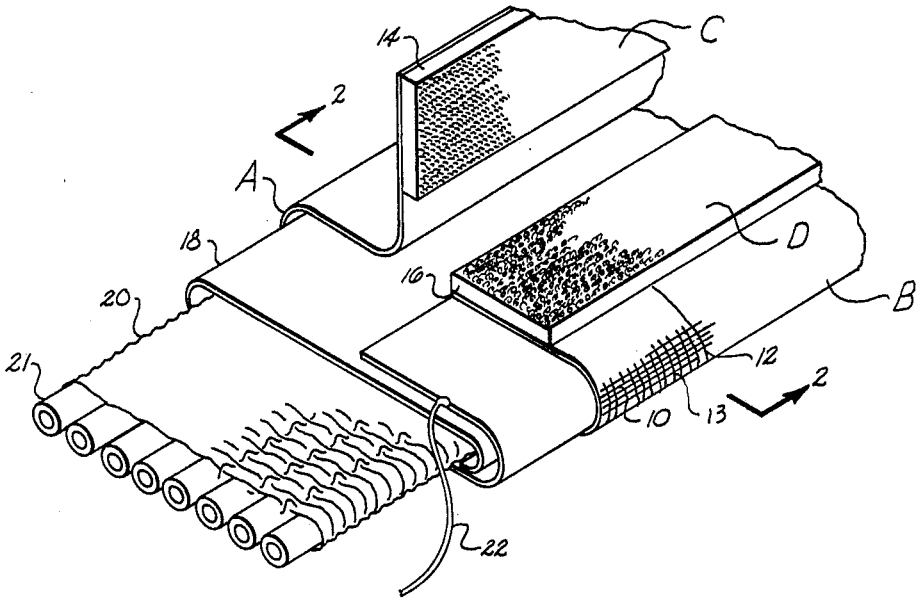
FIG. 1 is a perspective view illustrating a woven electrical transmission cable and woven jacket assembly for enclosing same.
Figure 2:
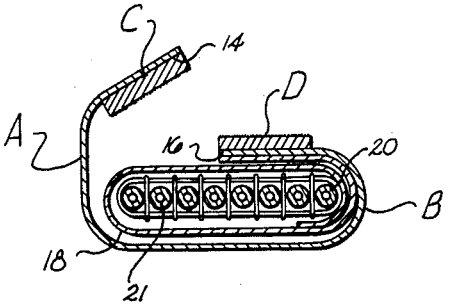
FIG. 2 is a sectional view taken along line 2—2 of FIG. 1.
Figure 3:
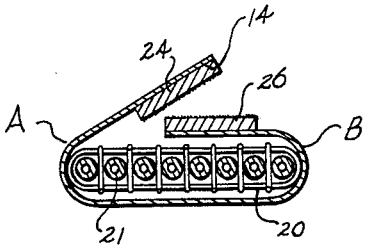
FIG. 3 is a front elevational view illustrating a woven jacket assembly for an electrical transmission cable wherein the metal foil shield is omitted and the shielding is provided by conductive Velcro fastener tapes.

The drawing illustrates a flexible woven jacket assembly A for enclosing woven electrical transmission cables of a generally flat configuration providing a flexible package while maintaining conductors of stacked cables generally fixed in their relative positions and for providing protection against abrasion.

In a preferred form, the woven jacket assembly A includes an elongated cover strip B constructed from wrap and fill strands woven together to form a generally solid outer cover fabric wherein the warp and fill strands consist essentially of aromatic polyamide fibers. The cover strip is woven to define a pair of longitudinal marginal edges. A strip of Velcro fastener hook tape C is carried adjacent one of the marginal edges and a strip of Velcro fastener loop tape D is carried adjacent the other marginal edge. The Velcro fastener tape is secured to the marginal edges with the woven cover strip wrapped about the transmission cable or cables.

As shown in FIG. 1, the elongated cover strip B may be woven from warp and fill strands 10 and 12, respectively, in the form of a conventional plain weave pattern shown schematically at 13 to provide a generally solid outer cover fabric such that protects the transmission cable against abrasion. The warp and fill strands are preferably an aromatic polyamide (polyaramid) such as NOMEX brand nylon which, in laboratory testing, has exhibited acceptable flame retardant properties covering products of this class. Furthermore, it has been found that a mixture of aromatic polyamide and polyamide fiber strands may be utilized advantageously wherein the aromatic polyamide affords the added fire retardancy to the mixture, and the added polyamide, being more elastic, provides elasticity to the woven structure and gives a better hand to the cover fabric. In order to provide a more highly flame resistant jacket assembly, a high Hi-Air Velcro fastener tape may be utilized having flame retardant properties. The Velcro fastener tapes C and D may be secured to respective marginal edges 14 and 16 by any suitable means such as adhesive or stitching.

As illustrated, the jacket assembly includes means for shielding the electrical transmission cable against unwanted electromagnetic noises, particularly external noises such as static electricity, lightning and radiation noises. In one embodiment, a metallic shield means is provided by a copper foil strip 18 carried within the woven cover strip B generally surrounding the transmission cable 20 having a plurality of conductors 21. The copper shield strip may be adapted for connection to ground by any suitable means such as a pigtail drain wire 22 soldered onto the foil strip and terminated at a ground terminal. The foil strip has a width slightly greater than the cover strip B and transmission cable 20 such that it may be wrapped around the transmission cable or cables, and for this purpose, a longitudinal edge of the foil strip may be secured adjacent one of the marginal edges 16 of the cover strip.

In the alternative, the metal foil strip may be omitted, and the shielding means may be provided by conductive loop and hook fastener tapes 24 and 26 at the marginal edges of the cover strip B. A suitable conductive hook and loop tape material is manufactured by the Velcro Corporation of Montclaire, New Jersey, and is referred to as Hi-Meg hook and loop tapes. The conductive tapes 24 and 26 may be applied to the marginal edges of the cover strip by any suitable adhesive and a pigtail drain wire may be utilized to ground the conductive fastener tapes for shunting the unwanted electrical noises.

As noted previously, the woven cover strip B is preferably coated with a stabilizing coating such as polyurethane to provide a better hand to the outer cover fabric and enhance protection against abrasion. In this manner, a less expensive and more light-weight cover fabric is had, since by utilizing a coating, a more dense weave pattern can be utilized while still affording a good body or hand to the fabric.

It has been found that the woven cover strip B and fastener tapes C and D or 24 and 26, may advantageously be provided with a sufficient width so as to afford adjustability to the joining of the marginal edges of the cover strip to accommodate a variety of transmission cable sizes as well as to accommodate different numbers of transmission cables. In this manner, a single jacket assembly may be used to jacket a single cable or to jacket a plurality of flat transmission cables stacked upon each other. In either case, the woven flexible jacket assembly provides a highly flexible cover package with the enclosed cables such that it is an expedient to the routing of the jacketed cables as in a machine frame or computer chassis.

Figure 4:
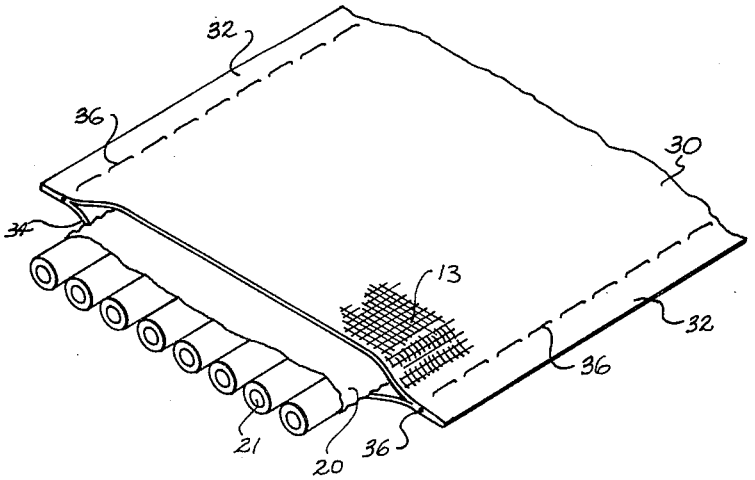
FIG. 4 is a perspective view illustrating an alternate embodiment of a woven jacket assembly for electrical transmission cables.

As illustrated in FIG. 4, an alternate embodiment for a woven jacket assembly includes an elongated cover strip 30 woven from polyamide warp and fill strands consisting preferably of aromatic polyamide fibers, wherein the strip is woven in a plain weave pattern to provide a generally solid outer cover fabric. The cover strip 30 is in the form of a tubular construction for receiving at least one woven transmission cable such as 20 therein. The stabilizing coating such as polyurethane is carried by the woven cover strip to provide a better hand and stability to the outer cover fabric more resistant to abrasion. The cover may be woven in a tubular form or, as illustrated, the cover strip 30 may be constructed from a pair of flat strips of cover fabric 32 and 34 having respective selvages joined together such as by ultrasonic bonding or stitching at 36. This provides a flexible woven jacket assembly which protects the conductors of the transmission cable and is very economical.

Thus, it can be seen that a highly advantageous construction for a flexible abrasion resistant jacket assembly can be had particularly wherein a flame retardant woven cover and closure are uniquely provided for adjustably accommodating a variety of cable sizes and in the number of cables together with shielding means, all of which afford a lightweight, flexible package.

While a preferred embodiment of the invention has been described using specific terms, such description is for illustrative purposes only, and it is to be understood that changes and variations may be made without departing from the spirit or scope of the following claims.

What is claimed is:

1. A flexible woven jacket assembly encasing a woven electrical transmission cable or cables of generally flat configuration providing protection against abrasion and for maintaining conductors of stacked cables generally fixed in their relative positions while affording a flexible package comprising:

at least one of said transmission cables;

an elongated cover strip constructed from warp and fill strands woven together to form a generally solid outer cover fabric;

said cover strip woven to define a pair of longitudinal marginal edges;

a strip of fastener hook tape carried adjacent one of said marginal edges;

a strip of fastener loop tape carried adjacent said other marginal edges;

said fastener tapes securing said marginal edges of said woven cover strip wrapped about the transmission cable; and said woven cover strip and fastener tapes having a sufficient width to afford adjustability to enable the jacket circumference of said cover strip to vary and said marginal edges be joined to accommodate a variety of sizes and numbers of said transmission cables such as when in a stacked configuration.

2. The assembly of claim 1 including metallic shield means carried by said cover strip affording protection against unwanted electromagnetic noises.

3. The assembly of claim 2 wherein said metallic shield means includes a foil strip carried within said woven cover strip generally surrounding said transmission cable, said foil shield strip adapted for connection to ground.

4. The assembly of claim 3 wherein said foil strip co-extends generally with said cover strip and includes a longitudinal edge secured adjacent one of said marginal edges of said cover strip.

5. The assembly of claim 2 wherein said shielding means is provided by said fastener tapes constructed from conductive material adapted for connection to ground affording electromagnetic shielding.

6. The assembly of claim 1 wherein said fastener tapes consist of conductive hook and loop fastener tapes.

7. The assembly of claim 1 wherein said warp and fill strands include polyamide fibers consisting essentially of aromatic polyamide fibers.

8. The assembly of claim 1 wherein said woven cover strip is coated with a stabilizing coating providing a better hand to the outer cover fabric and more resistance to abrasion.

9. The assembly of claim 1 wherein said warp and fill strands include a mixture of polyamide and aromatic polyamide fibers providing elasticity and fire retardancy to said cover fabric.

* * * * *